US006561279B2

(12) United States Patent
MacKenzie et al.

(10) Patent No.: US 6,561,279 B2
(45) **Date of Patent: *May 13, 2003**

(54) METHOD AND APPARATUS FOR COMPLETING A WELLBORE

(75) Inventors: Alan MacKenzie, Aberdeen (GB); Sebastian J. Wolters, Muscat (OM); Douglas J. Murray, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/178,375

(22) Filed: Jun. 24, 2002

(65) Prior Publication Data

US 2002/0157826 A1 Oct. 31, 2002

Related U.S. Application Data

(63) Continuation of application No. 09/668,328, filed on Sep. 22, 2000, now Pat. No. 6,419,026.
(60) Provisional application No. 60/169,705, filed on Dec. 8, 1999.

(51) Int. Cl.[7] ..... E21B 43/10
(52) U.S. Cl. ..... 166/381; 166/206
(58) Field of Search ..... 166/50, 380, 381, 166/206, 207, 277, 313

(56) References Cited

U.S. PATENT DOCUMENTS

| | | | | |
|---|---|---|---|---|
| 3,167,122 A | 1/1965 | Lang | | 166/14 |
| 3,364,993 A | 1/1968 | Skipper | | 166/4 |
| 5,325,924 A | 7/1994 | Bangert et al. | | 166/313 |
| 5,477,925 A | 12/1995 | Trahan et al. | | 166/382 |
| 5,520,252 A | 5/1996 | McNair | | 166/313 |
| 5,787,987 A | 8/1998 | Forsyth et al. | | 166/313 |
| 5,833,001 A | 11/1998 | Song et al. | | 166/287 |
| 5,875,847 A | 3/1999 | Forsyth | | 166/313 |
| 5,944,108 A | 8/1999 | Baugh et al. | | 166/313 |
| 6,009,949 A | 1/2000 | Gano et al. | | 166/313 |
| 6,012,526 A | 1/2000 | Jennings et al. | | 166/298 |
| 6,070,671 A | 6/2000 | Cumming et al. | | 166/381 |
| 6,073,697 A | 6/2000 | Parlin et al. | | 166/313 |
| 6,199,633 B1 | 3/2001 | Longbottom | | 166/242.6 |

*Primary Examiner*—Frank S. Tsay
(74) *Attorney, Agent, or Firm*—Cantor Colburn LLP

(57) ABSTRACT

A method and apparatus to provide a large bore hook hanger system incorporating sand exclusion at a junction in a multilateral wellbore includes the running of a lateral liner having an expandable sleeve positioned thereon to bridge a milled window from the lateral borehole to the primary borehole, expandable sleeve including a pre-machined window and a hook to hang the liner from the primary borehole. The hook further acts to center the pre-machined window in the expandable sleeve to provide access to the primary wellbore. The expandable sleeve is preferably covered on its outer surface with an elastomeric material and is outwardly concentric to an expandable packer for run-in. Once the expandable sleeve is positioned at the appropriate location in the junction, the expandable packer is inflated thus permanently deforming the expandable sleeve into contact with the open hole of the lateral borehole thereby preventing sand or gravel ingress to the primary borehole.

18 Claims, 7 Drawing Sheets

METHOD AND APPARATUS FOR COMPLETING A WELLBORE

CROSS REFERENCE TO RELATED APPLICATIONS

This is a continuation of U.S. application Ser. No. 09/668,328, filed Sep. 22, 2000, now U.S. Pat. No. 6,419,026, which claims the benefit of an earlier filing date from U.S. Ser. No. 60/169,705, filed Dec. 8, 1999, the entire contents of which is incorporated herein by reference.

BACKGROUND OF THE INVENTION

1. Field of the Invention

The invention relates to the field of hydrocarbon production. More particularly, the invention relates to improving the junction between a main wellbore and lateral wellbore to prevent sand or other solids from entering the main wellbore through the junction window.

2. Prior Art

Liners have been run in lateral boreholes with great success commercially. Generally a lateral borehole is drilled off a whipstock through a milled window in a cased or uncased primary borehole. It should be understood that the terms "primary" and "lateral" as used in this application are intended to mean a primary borehole being the borehole from the surface and a lateral extending from that primary wellbore but also encompass a secondary lateral borehole drilled off a preexisting lateral wellbore. In that case the preexisting lateral borehole is considered to be the "primary" borehole and the secondary lateral borehole is considered to be the "lateral" borehole for purposes of this disclosure.

Subsequent to milling the window in the primary borehole and drilling the lateral borehole, a running tool is introduced to the primary borehole carrying a lateral liner. At the uppermost portion of lateral liner a slotted sleeve has been used to provide some structural support to the junction of the lateral borehole and the primary borehole. This is particularly useful in unconsolidated well formations and allows rapid completion of lateral borehole junctions in order to reduce the costs associated with that completion.

While the method and apparatus known to the prior art as set forth above is favored by many and has performed well for its intended purpose, it does unfortunately have a drawback in that solids such as sand, gravel, etc. can make their way into the main wellbore by sliding around the annulus existing between the open hole and the slotted sleeve. While the well can still be produced with such solids, it is well known to the art that sand and other solids have detrimental effects on wellbore equipment and pumping equipment and indeed if a pump is dropped below the lateral window that is the source of sand ingress it would be directly exposed to such solids and likely would have a very limited life expectancy.

SUMMARY OF THE INVENTION

The above-identified drawbacks of the prior art are overcome, or alleviated, by the method and apparatus of the invention.

The invention employs an expandable sleeve device which for purposes of this application means a sleeve having a plurality of openings through an outer surface thereof to promote expansion of the device due to pressure exerted thereagainst from an inside surface thereof. A preferred embodiment employs slots which are offset to one another such that the device is expandable by deformation of the slots. The device includes a hook protruding from one side thereof and a premachined window uphole of and centered with respect to the hook. The premachined window provides main borehole access when the expandable sleeve device is in place while the hook ensures that the premachined window is aligned with the main borehole by engaging with the milled window in the primary borehole casing. The expandable sleeve junction further includes an outer material which is also expandable and which will prevent ingress of fluids and solids through the slots in the expandable sleeve junction. Once deformed, the expandable sleeve junction provides enhanced (over the prior art) structural support to an unconsolidated well formation in an open hole and further prevents particulate matter from entering the main bore by washing around the annulus of the expandable sleeve. This is accomplished since the annulus has been reduced sufficiently by expansion of the expandable sleeve junction to where sand and other particulate matter will bridge naturally and be excluded from ingress to the main wellbore.

In general terms, the expandable sleeve junction is mounted to the uphole end of a standard liner and on a running tool to be delivered to the desired junction. The expandable sleeve junction engages with a milled window through which the liner has passed. The sleeve both hangs and is oriented to the primary borehole via the hook. Following run-in, a packer or other expandable element is expanded inside the expandable sleeve junction thereby expanding its outside dimensions. The expandable sleeve is preferably expanded at least nearly into contact with the open hole bore of the lateral borehole. Subsequent to this deformation, the packer or other element is deactuated and the running tool withdrawn from the wellbore.

The invention ensures that significant particulate matter will not enter the main borehole and therefore not damage downhole equipment. Another and important benefit of the invention over prior art systems is that it allows for complete installation without requiring additional runs of tools in the wellbore. Thus, no additional expense is required with respect to setting the slotted sleeve junction beyond what would be required to set a liner in the lateral borehole. It will of course, be understood that more runs could be added if desired.

IN THE DRAWINGS

Referring now to the drawings wherein like elements are numbered alike in the several FIGURES:

FIG. 1 is a schematic cross-section of the slotted sleeve junction of the invention illustrating both the elastomeric outer covering and the slotted sleeve as well as the premachined window and hook;

FIG. 2 schematically illustrates a protective sleeve employed to prevent the packer from extruding through the premachined window in the slotted sleeve junction.

DETAILED DESCRIPTION OF THE INVENTION

The invention as noted solves preexisting problems of sand or other small particulate ingress to the primary borehole at a junction thereof with a lateral borehole. Also, and as stated, this is accomplished through a particular method of the invention which is preferably made possible by employment of an apparatus of the invention. Initially, therefore, reference is made to FIGS. 1 and 2 to introduce the apparatus of the invention after which the preferred method of its use is discussed.

Figure 1:
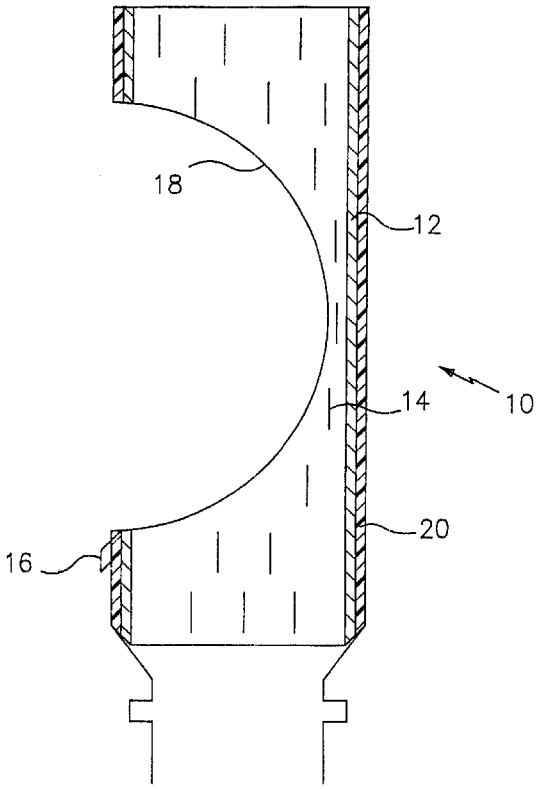

Referring to FIG. 1, a cross section view of an expandable sleeve junction 10 which may comprise solid material or in one preferred embodiment and as illustrated may comprise a slotted sleeve. In the following description, the slotted embodiment is detailed. It will be understood, however, that solid materials being swaged to expand them, etc. are contemplated herein. The construction of junction 10 preferably includes a slotted sleeve 12 constructed of a metal such as steel which still exhibits, strength after deforming. Sleeve 12 includes slots 14 (as shown in the drawings however other shapes can be substituted as noted above with the goal of allowing the sleeve to expand) in an offset pattern facilitative of an expansion of the outside diameter of the junction 10 by opening of slots 14. The particular dimensions of undeformed slots 14 will depend upon the degree of expansion of junction 10 desired. Determining the dimensions of the slots needed to allow the desired expansion is within the level of skill of one of ordinary skill in the art.

Attached to sleeve 12 is hook 16 to support a lateral liner in the lateral borehole. The hook 16 operates as does a prior art hook liner hanger system such as product no.29271, commercially available from Baker Oil Tools, Houston, Tex. In connection with the invention, hook 16 is employed also to orient a primary borehole access window 18 with a primary borehole from which the subject lateral extends. Window 18 provides full bore access to the primary borehole subsequent to the method of the invention being completed.

Since expansion the slotted sleeve 12 will necessarily cause relatively large dimension openings to exist throughout sleeve 12, it is desirable and preferable to provide a material on an outside surface of sleeve 12 as illustrated at 20. Material 20 can be constructed of any material that has expandable characteristics and is capable of withstanding the environment downhole. Rubber or plastic material is preferred although it is possible that a metallic material could be employed if it possesses the desired expansion characteristics. Material 20 functions to seal all of the openings of slots 14 to screen out substantially any particulate matter from entering the primary borehole.

Figure 2:
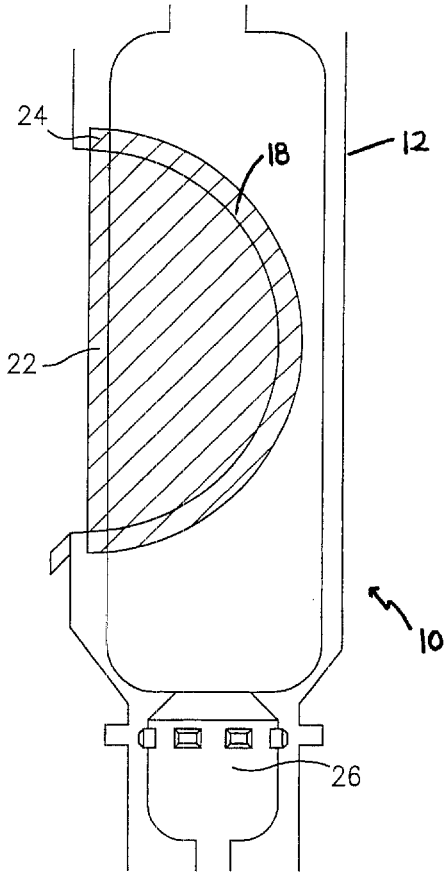

Referring now to FIG. 2, a shield 22 is illustrated. Shield 22 is constructed to nest with window 18 of sleeve 12 to prevent extrusion of a packer through that window upon expansion thereof to expand the junction 10 in accordance with the method of the invention. The shield 22 preferably includes boundary area 24 which overlaps with edges of window 18. Shield 22 is thus put into place in the window from the inside of junction 10 and thereby cannot be pushed through window 18 to the outside of junction 10.

FIG. 2 also provides a schematic illustration of position of the components of the invention by illustrating a conventional running tool 26. The operation of the tool of the invention and other components thereof will be further understood through reference to FIGS. 3–8 which provide a schematic sequential view of the tool in action.

Figure 3:
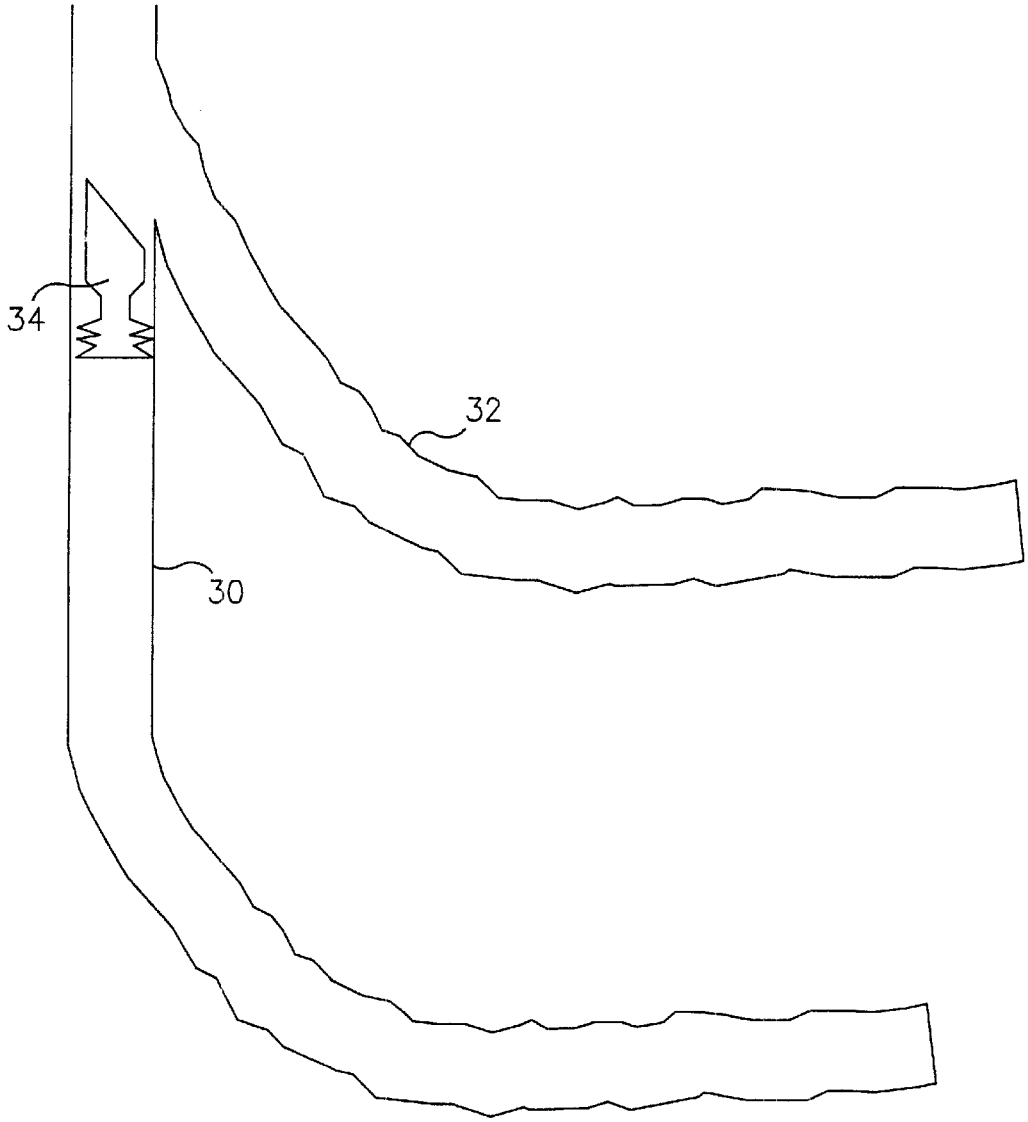
FIG. 3 is a schematic view of a primary and lateral wellbore illustrated with a whipstock mounted in the primary wellbore.
Figure 4:
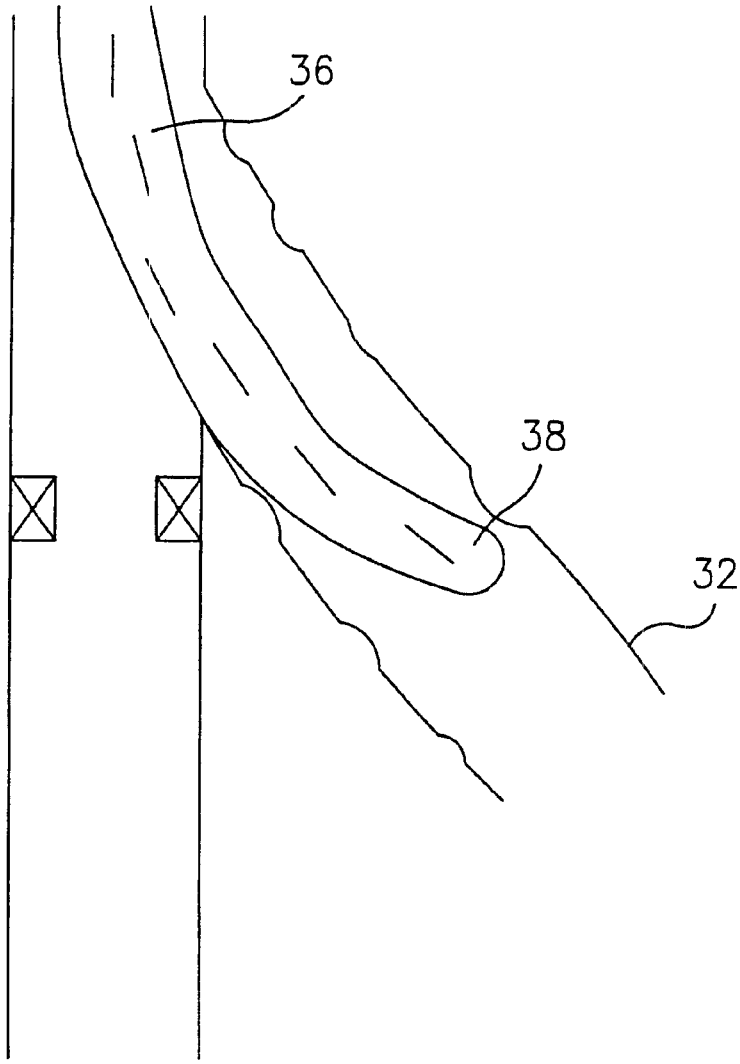
FIG. 4 is a schematic illustration of the same wellbore after the packer has been removed and the downhole end of a liner with a bent sub is being introduced to the lateral borehole.
Figure 5:
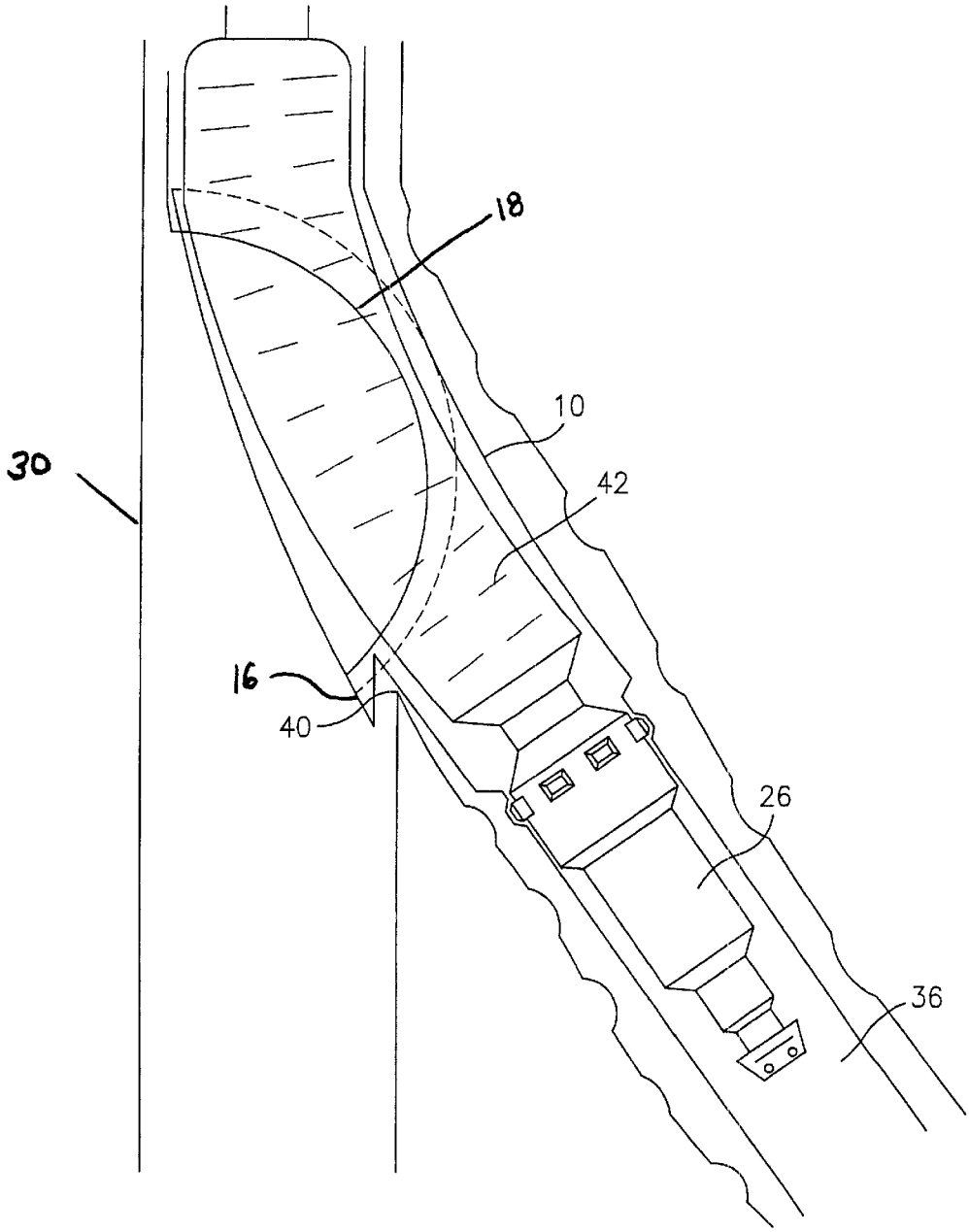
FIG. 5 is a schematic illustration of the invention being placed at the junction between the primary borehole and the lateral borehole.

One of ordinary skill in the art will recognize the illustration of FIG. 3 as a primary borehole 30 and a lateral borehole 32. One will also recognize the schematic depiction of a whipstock 34 placed in primary borehole 30 immediately downhole of an intersection with lateral borehole 32. Referring now to FIG. 4, the whipstock 34 has been removed from the primary borehole 30 and a liner 36 is being run in the hole. Preferably liner 36 includes a bent sub 38 at the downhole end to allow the assembly to easily enter the lateral borehole 32. In FIG. 5, liner 36 is at its final depth and the slotted sleeve junction 10 of the invention is illustrated in place with the hook 16 engaged with window 40 of primary borehole. As is known, hook 16 supports the weight of liner 36 but additionally in the invention, acts to orient window 18 with primary borehole 30. It is important to note that an expandable element is also positioned on running tool 26. Expandable element 42 may be an inflatable packer, squeeze packer or other device capable of increasing the dimensions of slotted sleeve junction 10 through deformation.

Figure 6:
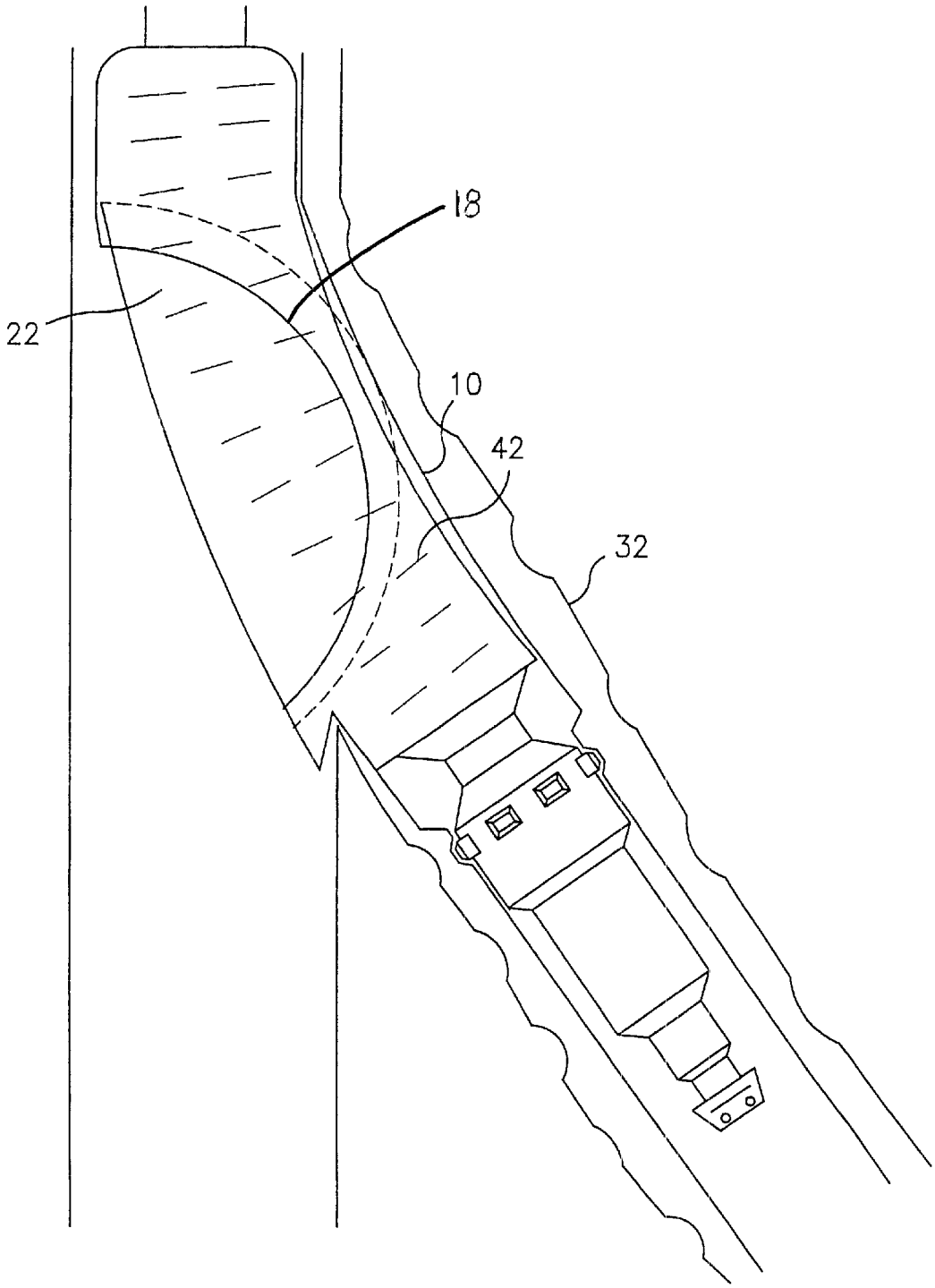
FIG. 6 is another schematic illustration showing the packer expanding within the slotted sleeve junction to expand the same.
Figure 7:
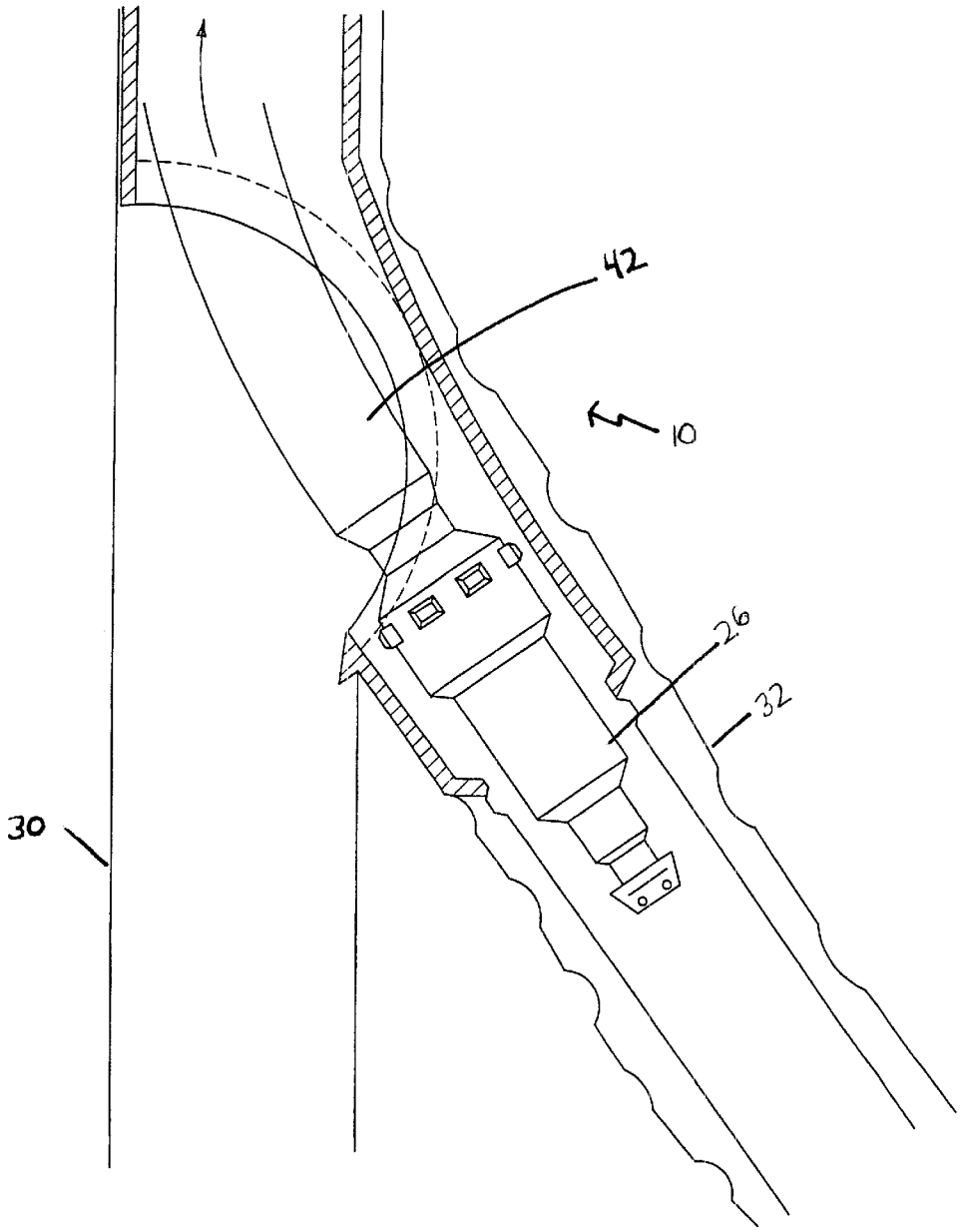
FIG. 7 illustrates the next step in the process of the invention with the expandable element unexpanded and be in a condition where the running tool will be removed from the wellbore.
Figure 8:
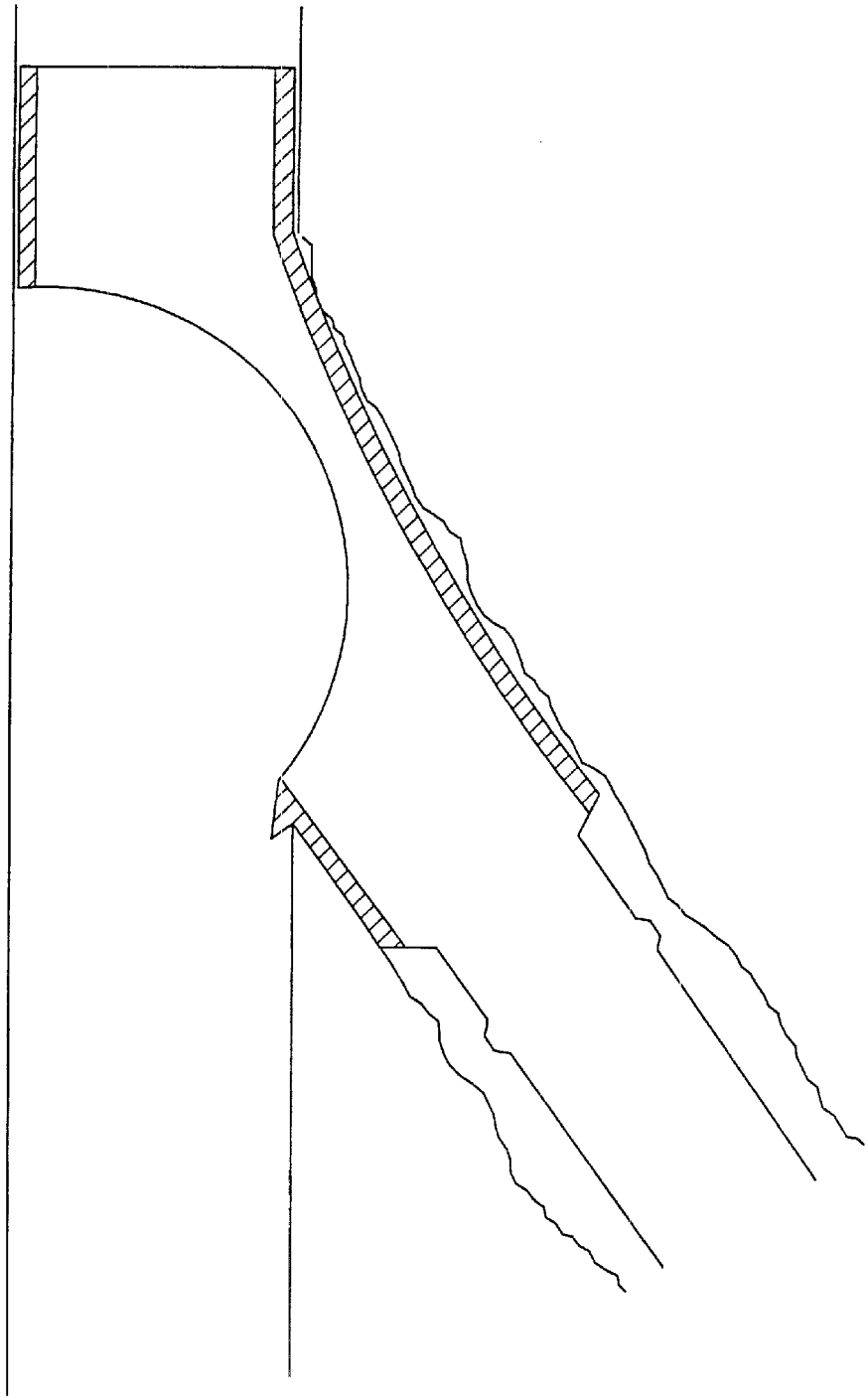
FIG. 8 is a schematic illustration of the completed wellbore with the slotted sleeve junction and the liner permanently installed.

Referring to FIG. 6, the element 42 is illustrated in an expanded condition which urges junction 10 against borehole 32. Shield 22 is shown preventing the expansion of element 42 through window 18. Upon completion of the expansion phase the junction is permanently deformed to exhibit a larger outside dimension than it possessed at run-in whereby structural support is provided to the borehole 32 near its root. Subsequently, and with reference to FIG. 7, the expandable element 42 is unexpanded and can be withdrawn from the wellbore. This leaves junction 10 in place against the walls of borehole 32 with a small enough gap between the borehole and the junction 10 to facilitate natural sand bridging and therefore exclude such sand from the primary borehole 30. It will also be noted that as element 42 and running tool 26 are withdrawn from the wellbore, shield 22 is likewise withdrawn although it is not illustrated in FIG. 7. FIG. 8 illustrates, schematically, the completed wellbore.

The device of the invention and its method of installation significantly improve the prior art since in the same run into the well as is done in the prior art, the invention eliminates the drawbacks of the prior art as discussed hereinabove.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A junction comprising:

an expandable sleeve having one or more openings;

a premachined window in said expandable sleeve; and a hook extending from said expandable sleeve and engageable with a window in a primary borehole.

2. A junction as claimed in claim 1 wherein said one or more openings are arranged in an offset pattern.

3. A junction as claimed in claim 1 wherein said one or more openings are slots.

4. A junction tool comprising:

an expandable sleeve having one or more openings;

a premachined window in said expandable sleeve;

a hook extending from said expandable sleeve and engageable with a window in a primary borehole;

a liner extending from said expandable sleeve;

a shield positioned in said premachined window in said expandable sleeve; and an expandable element disposed within said expandable sleeve.

5. A junction tool as claimed in claim 4 wherein said one or more openings are slots.

6. A junction tool as claimed in claim 4 wherein said expandable sleeve further includes a material disposed at an outside surface thereof.

7. A junction tool as claimed in claim 6 wherein said material is expandable without rupturing.

8. A junction tool as claimed in claim 6 wherein said material is elastomeric.

9. A junction tool as claimed in claim 6 wherein said material is metallic.

10. A junction tool as claimed in claim 4 wherein said one or more openings are offset.

11. A method for forming a junction between a primary borehole and a lateral borehole in a wellbore comprising:

running a liner and expandable sleeve together to depth, said expandable sleeve having an expandable element disposed therein, said expandable sleeve having one or more openings;

expanding said expandable element to deform said expandable sleeve into close proximity with an annular wall of at least one of said primary borehole and said lateral borehole; and collapsing said expandable element to be withdrawn from the wellbore.

12. A method for forming a junction as claimed in claim 11 wherein said one or more openings are slots.

13. A method for forming a junction between a primary borehole and a lateral borehole in a wellbore as claimed in claim 11 wherein said one or more openings are offset.

14. A method for forming a junction as claimed in claim 11 wherein said expandable element is expanded by dropping a ball and pressuring up on a tubing string connecting said element to an uphole location.

15. A method for forming a junction as claimed in claim 11 wherein said method includes causing said expandable sleeve to interact with at least one of said primary borehole and said lateral borehole so that particulate matter bridges naturally and is excluded from said primary borehole.

16. A method for forming a junction between a primary borehole and a lateral borehole in a wellbore in a single run into the wellbore comprising:

running a liner, an expandable sleeve and an expandable element into the wellbore in a single run, said expandable sleeve having one or more openings;

expanding said expandable element to expand said sleeve into close proximity with an annular wall of at least one of said primary borehole and said lateral borehole; and removing said expandable element from said expandable sleeve.

17. A method for forming a junction as claimed in claim 16 wherein said one or more openings are arranged in an offset pattern.

18. A method for forming a junction as claimed in claim 16 wherein said one or more openings are slots.

* * * * *